United States Patent [19]

Langowski

[11] 3,937,514

[45] Feb. 10, 1976

[54] GUIDE HEAD FOR PIPE RACKERS

[75] Inventor: Faustyn C. Langowski, Houston, Tex.

[73] Assignee: Byron Jackson Inc., Long Beach, Calif.

[22] Filed: Nov. 22, 1974

[21] Appl. No.: 526,208

[52] U.S. Cl. ..... 294/88; 214/2.5; 294/90; 294/106

[51] Int. Cl.[2] ..... E21B 19/00

[58] Field of Search ..... 214/2.5, 1 P, DIG. 3; 294/88, 90, 106, 113, 115; 175/85

[56] References Cited

UNITED STATES PATENTS

| | | | |
|---|---|---|---|
| 3,021,168 | 2/1962 | Bodine | 294/106 X |
| 3,312,291 | 4/1967 | Haug | 294/106 X |
| 3,472,404 | 10/1969 | Ord | 294/113 X |
| 3,561,811 | 2/1971 | Turner, Jr. | 294/90 |

*Primary Examiner*—Frank E. Werner
*Attorney, Agent, or Firm*—John O. Evans, Jr.

[57] ABSTRACT

A pipe guide head for well pipe racking apparatus has plural slides defining different sizes of pipe receiving guide openings, extensible from retracted positions within the body to extended positions for receiving pipe, each slide being connected with a lever arm pivoted on the body to close the lever arm across the pipe opening upon extension of the slide and open the lever upon retraction of the slide. Fluid pressure operated actuators are connected with the slides to extend and retract them.

5 Claims, 5 Drawing Figures

GUIDE HEAD FOR PIPE RACKERS

BACKGROUND OF THE INVENTION

In the drilling of wells, such as oil and gas wells, it is desirable to rack the stands of drill pipe and drill collars in racking means in the derrick or beneath the floor of the derrick. Such racking apparatus necessitates the movement of successive pipe stands between racked positions and a position at the center of the derrick, and the pipe must be transferred between such positions by suitable supporting means engageable beneath the usual shoulder provided by the tool joint or coupling end of the pipe.

To conserve space in the rack, the pipe is racked in close, side by side relation in sequence, by pipe lifting and positioning means such as that disclosed in U.S. Pat. No. 3,561,811, granted Feb. 9, 1971, or in the companion application for U.S. Patent Ser. No. 526,207, filed Nov. 22, 1974. In either case, the pipe is supported in a head which engages beneath the upset or shoulder of the tool joint to support the pipe and move it during the racking and unracking operations.

In order to constrain the pipe against swinging in the derrick and to position the pipe with respect to the rack and the center of the derrick a positioning guide means may be employed, for example, as disclosed in the aforesaid companion application Ser. No. 526,207. Such positioning guide means must accommodate a variety of pipe sizes, such as drill pipe and larger drill collars, as well as, at other times different sized drill pipe and drill collars.

SUMMARY OF THE INVENTION

The present invention provides an improved guide head for pipe rackers of the type referred to above, wherein the pipe receiving openings are formed in slide plates shiftable to and from pipe receiving positions. Retainer arms are actuated to and from pipe retaining positions with respect to the slides in response to movement of the slides, whereby the opening and closing action is sure and rapid.

More particularly, the head has a body structure adapted to be mounted on a positioning arm, as disclosed in the aforementioned application for patent. Within the body, a pair of slide plates are reciprocable between retracted positions and extended positions. The slide plates have pipe receiving openings defined by arcuate edge walls adapted to form an inner arcuate guide surface substantially conforming to the size of the pipe. Closure arms, or levers are pivotally mounted on the body and have free ends swingable to and from positions confronting the slide plates to provide outer pipe engaging guide surfaces. The other ends of the levers are connected to the slides, so that actuation of the levers is responsive to movement of the slide and the overall opening and closing of the guide is rapid.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principles of the invention; but it is to be understood that such detailed descriptions are not to be taken in a limiting sense, since the scope of the invention is best defined by the appended claims.

BRIEF DESCRIPTIONS OF THE DRAWINGS

DESCRIPTION OF THE PREFERRED EMBODIMENT

Figure 1:
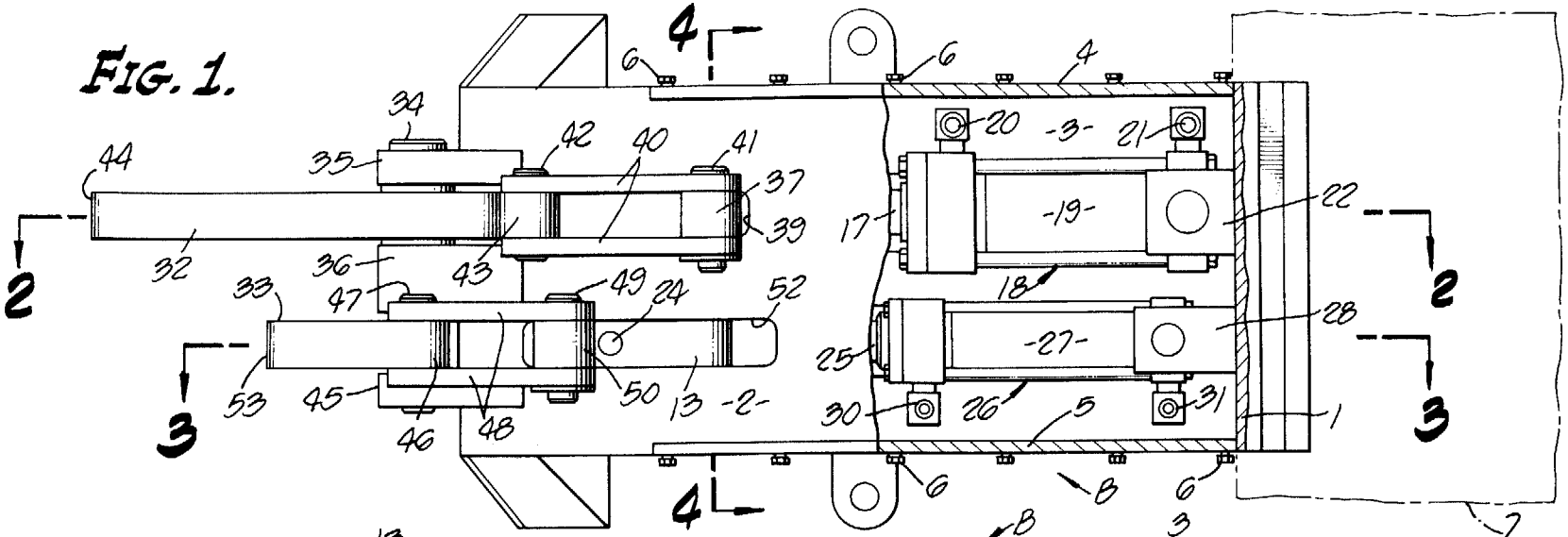
FIG. 1 is a side elevation, with a portion of the body broken away, of a guide head for pipe rackers embodying the invention.
Figure 2:
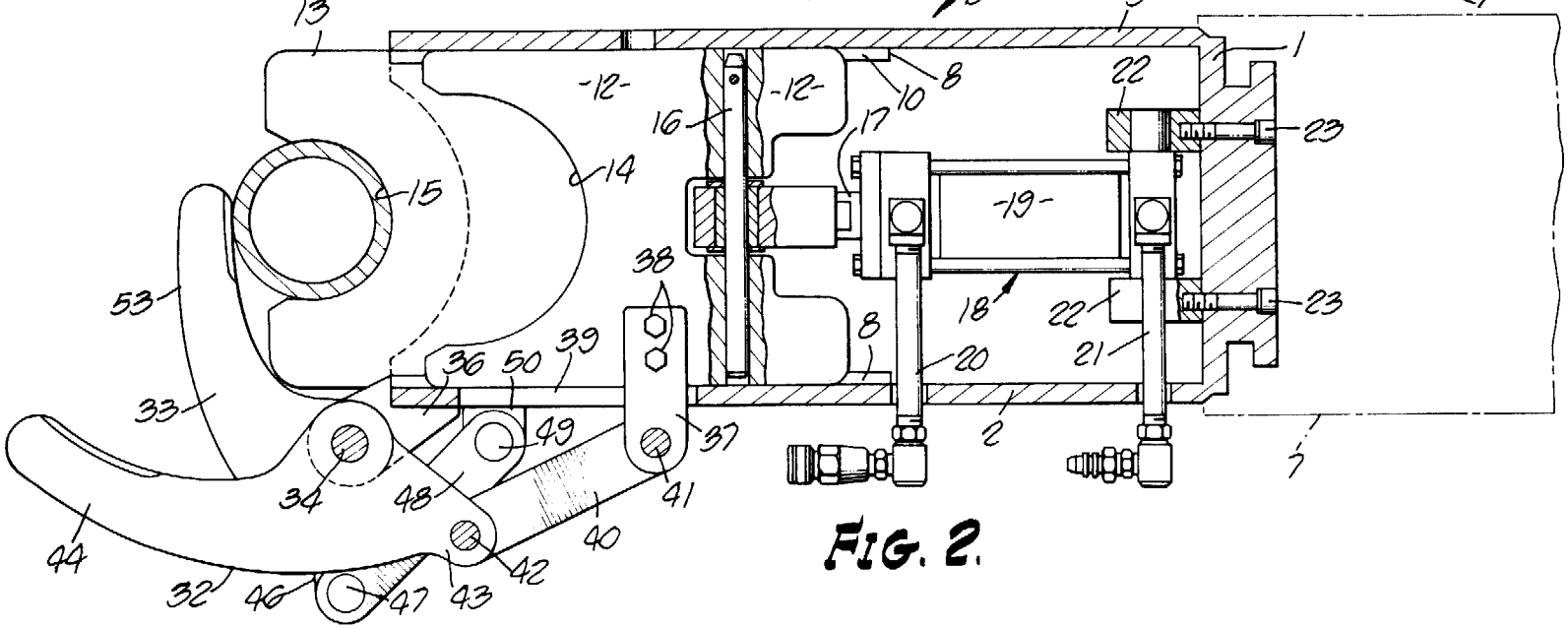
FIG. 2 is a horizontal section, as taken on the line 2—2 of FIG. 1.
Figure 3:
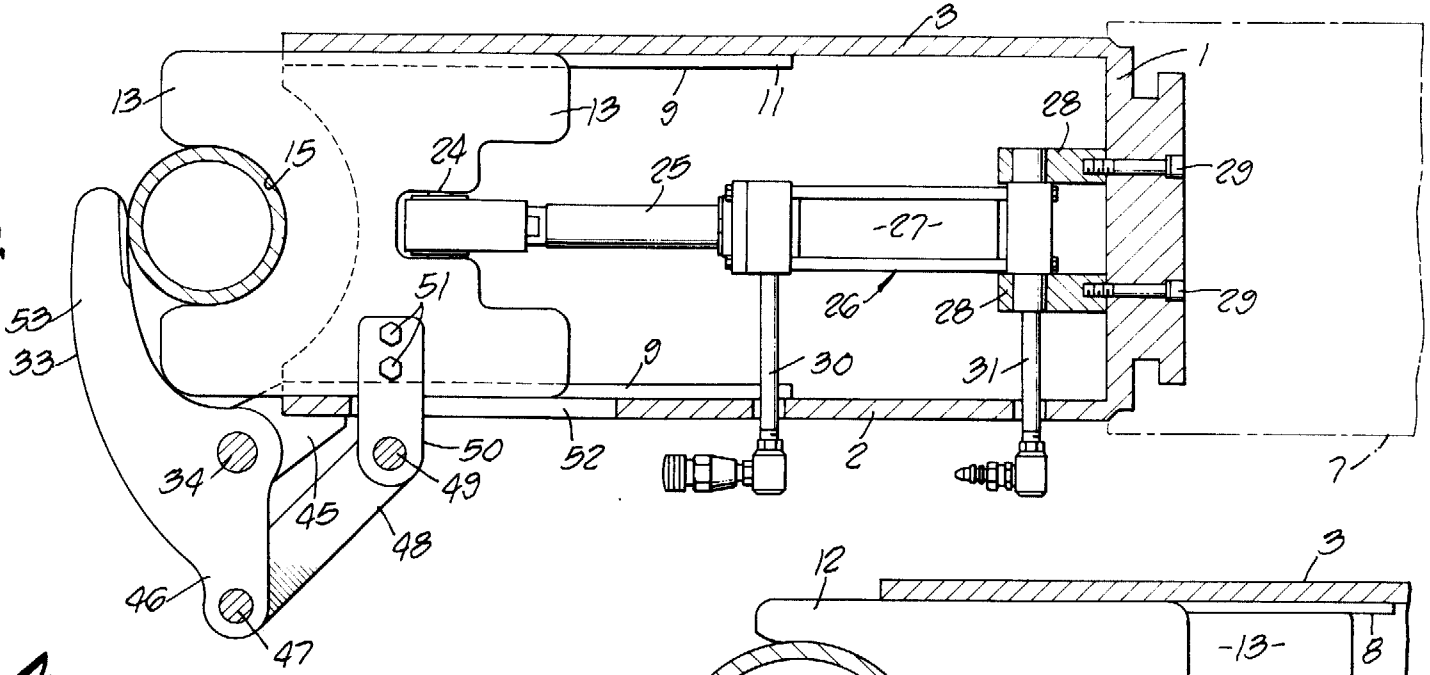
FIG. 3 is a horizontal section, as taken on the line 3—3 of FIG. 1.

As seen in the drawings, the guide head comprises a hollow, rectangular body B having a rear end wall 1 and side walls 2 and 3 suitably joined to or formed with the rear wall 1. Top and bottom walls 4 and 5 are secured to the side walls by fasteners 6. The rear wall 1 is configured for attachment to the support 7, shown in broken lines in FIGS. 1–3, such as the positioning arm of the aforementioned companion application, so as to be shiftable laterally and towards and away from the center of a well drilling derrick. The side walls 2 and 3 of the body are formed with or provided with longitudinally extended parallel ribs 8 and 9 forming vertically spaced tracks or guides 10 and 11 for receiving a pair of guide plates or slides 12 and 13. Upper slide 12 has an arcuate pipe receiving opening defined by an arcuate edge wall 14 of a size, say, adapted to receive a drill collar of relatively large diameter. Lower slide 13 has an arcuate pipe receiving opening defined by an arcuate edge wall 15 of a size, say, to receive a drill pipe of relatively small diameter. Each of the slides 12 and 13 is adapted to be shifted in its tracks between a retracted position between the side walls of the body and an extended position projecting forwardly from the open front end of the body.

Accordingly, the slide 12 is connected by a pin 16 with the rod 17 of a double acting pressure operated actuator 18 having a cylinder 19 connected with a pressure source through the usual fittings 20, 21. The acuator 18 is anchored to the rear wall 1 of the body in blocks 22 secured to the end wall 1 by fasteners 23. Correspondingly, the slide 13 is connected by a pin 24 with the rod 25 of a double acting, pressure operated actuator 26 having its cylinder 27 anchored to the end wall 1 by blocks 28 and fasteners 29. Fluid connections 30, 31 are provided to supply and exhaust fluid to and from the cylinder 27, as customary.

Figure 5:
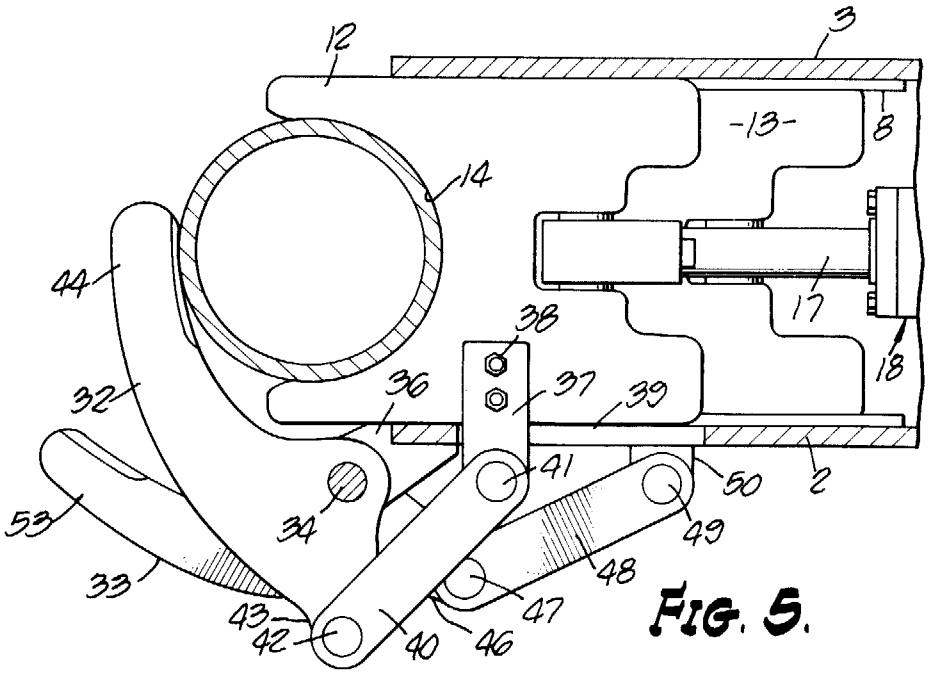
FIG. 5 is a fragmentary view generally corresponding with FIG. 3, but showing the upper slide in its extended condition.
Figure 4:
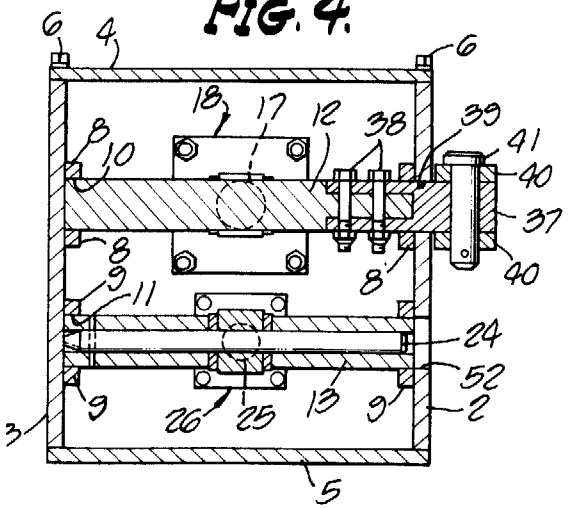
FIG. 4 is transverse section, as taken on the line 4—4 of FIG. 1.

Associated with the slide 12 is a lever arm or retainer 32 constituting means actuatable in response to extension and retraction of the slide 12 for retaining a pipe in the pipe opening, as seen in FIG. 5, or releasing the pipe. Correspondingly, a lever arm or retainer 33 is associated with the slide 13 and is actuatable between the closed position of FIGS. 2 and 3 retaining the pipe in the slide opening, and the open position of FIG. 5, responsive to extension and retraction of the slide 13.

This lever arm or retainer 32 is pivotally mounted between its ends on a pin 34 which extends vertically between lever support ears 35 and 36 welded or formed on the body side wall 2 and projecting outwardly therefrom. A connector 37 is fastened to the slide 12 by fasteners 38 and projects outwardly through an elongated slot 39 in the side wall 2. A link 40 is pivotally connected by a pin 41 with the connector 37 and by a pin 42 to an actuating arm 43 of the lever 32, at one side of the pivot pin 34. At the other side of the pivot pin 34, the lever 32 has an arched free end or arm portion 44 adapted to move to the position of FIG. 5, closing the gap at the front of the slide 12 when the slide 12 is extended by the actuator 18. With the lever 32 in the closed position, the pipe is retained between the slide 12 and the lever arm 32.

Likewise, the lever arm or retainer 33 is pivoted on the pin 34 between the support ear 36 and a lower support ear 45 welded or formed on the body wall 2, and has an actuator arm 46 connected by a pin 47 with a link 48 which is in turn connected by a pin 49 with a connector 50 secured to the slide 13 by fasteners 51. The connector 50 extends through an elongated slot 52 in the body side wall 2, so that extension of the slide 13 to the position of FIG. 3 actuates the lever 33 to dispose its free arm 53 in position to confine the pipe within the pipe opening 15 of the slide 13. Retraction of the slide opens the lever 33, as seen in FIG. 5.

Since the motion of the slides 12 and 13 and the levers 32 and 33 are combined, the lever action is quick. Moreover, since the rod end of the actuators 18 and 26 is connected to the slide the actuating motion is quick. Thus, when desired, the head can be quickly opened and closed as the pipe, guided by the head, is raised and lowered and enlargements on the pipe, such as tool joints and protective collars can readily pass through the head during the racking and unracking of pipe.

I claim:

1. A pipe guide head for well pipe racking apparatus comprising: a hollow body having means at one end for connection with a supporting and positioning structure, guide means at the other end of said body for receiving and guiding a length of pipe, said guide means including a slide plate, means reciprocably supporting said slide plate for extension and retraction with respect to said body, actuator means associated with said body and said slide plate for reciprocating said slide plate, said slide plate having a pipe receiving opening in its end, retainer means mounted on said body and movable between an open position and a closed position for retaining a pipe in said opening, and linkage means associated with said slide plate and said retainer means for moving said retainer means to said open position in response to retraction of said slide plate and for moving said retainer means to said closed position in response to extension of said slide plate.

2. A pipe guide head as defined in claim 1, wherein said retainer means comprises a lever arm pivoted between its ends on said body and having an actuator arm and a pipe retainer arm at opposite sides of its pivotal mounting, and said linkage means includes a link connecting said actuator arm with said slide plate.

3. A pipe guide head as defined in claim 1, wherein said retainer means comprises a lever arm pivoted between its ends on said body and having an actuator arm and a pipe retainer arm at opposite sides of its pivotal mounting, and said linkage means includes a link connecting said actuator arm with said slide plate, and said actuator means comprises double acting fluid pressure operated actuator cylinder means connected between said slide plate and said body.

4. A pipe guide head as defined in claim 1, wherein said retainer means comprises a lever arm pivoted between its ends on said body and having an actuator arm and a pipe retainer arm at opposite sides of its pivotal mounting, and said linkage means includes a link connecting said actuator arm with said slide plate, and said actuator means comprises double acting fluid pressure operated actuator means having a rod connected to said slide plate and a cylinder connected to said body.

5. A pipe guide head as defined in claim 1, wherein said retainer means comprises a lever arm pivoted on said body and having an actuator arm and a pipe retainer arm, and said linkage means includes a link connecting said actuator arm to said slide plate.

* * * * *